United States Patent [19]

Glinka et al.

[11] Patent Number: 4,534,373

[45] Date of Patent: Aug. 13, 1985

[54] DISPENSING MACHINE WITH REMOVABLE DISPENSING UNIT

[75] Inventors: John Glinka, Mt. Prospect; Leonard A. Fish, Chicago, both of Ill.

[73] Assignee: Casino Technology, Schiller Park, Ill.

[21] Appl. No.: 428,562

[22] Filed: Sep. 30, 1982

[51] Int. Cl.[3] ..... G07D 1/02

[52] U.S. Cl. ..... 133/5 R; 133/8 R; 221/197

[58] Field of Search ..... 133/2, 1 R, 1 A, 4 R, 133/4 A, 5 R, 8 R, 8 A; 194/1 D, 1 B, 1 F, 4 C, DIG. 15; 221/197

[56] References Cited

U.S. PATENT DOCUMENTS

| | | | |
|---|---|---|---|
| 1,776,251 | 9/1930 | Donnellan | 133/1 R X |
| 3,187,760 | 6/1965 | Simjian | 133/4 R |
| 3,675,816 | 7/1972 | Bourke et al. | 221/12 X |
| 3,791,574 | 2/1974 | Picquot | 133/1 R X |
| 4,150,740 | 4/1979 | Douno | 194/4 C |
| 4,249,553 | 2/1981 | Sentoku | 133/1 A |

*Primary Examiner*—F. J. Bartuska

*Attorney, Agent, or Firm*—Hill, Van Santen, Steadman & Simpson

[57] ABSTRACT

A vending machine for tokens, coins or the like incorporating a bill acceptor, a supply hopper, a dispensing unit, and a pair of delivery chambers, by which a programmable quantity of tokens are delivered to a delivery tray in accordance with the programming of a control system. An intermediate hopper located between the supply hopper and the dispensing unit facilitates disassembly of the apparatus without requiring the supply hopper to be emptied.

9 Claims, 12 Drawing Figures

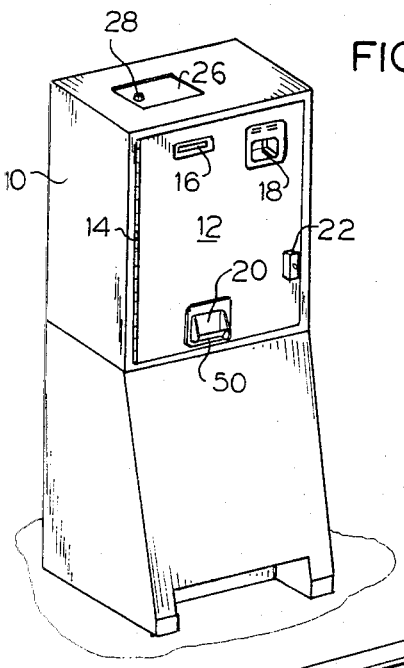
FIG. 1
FIG. 2
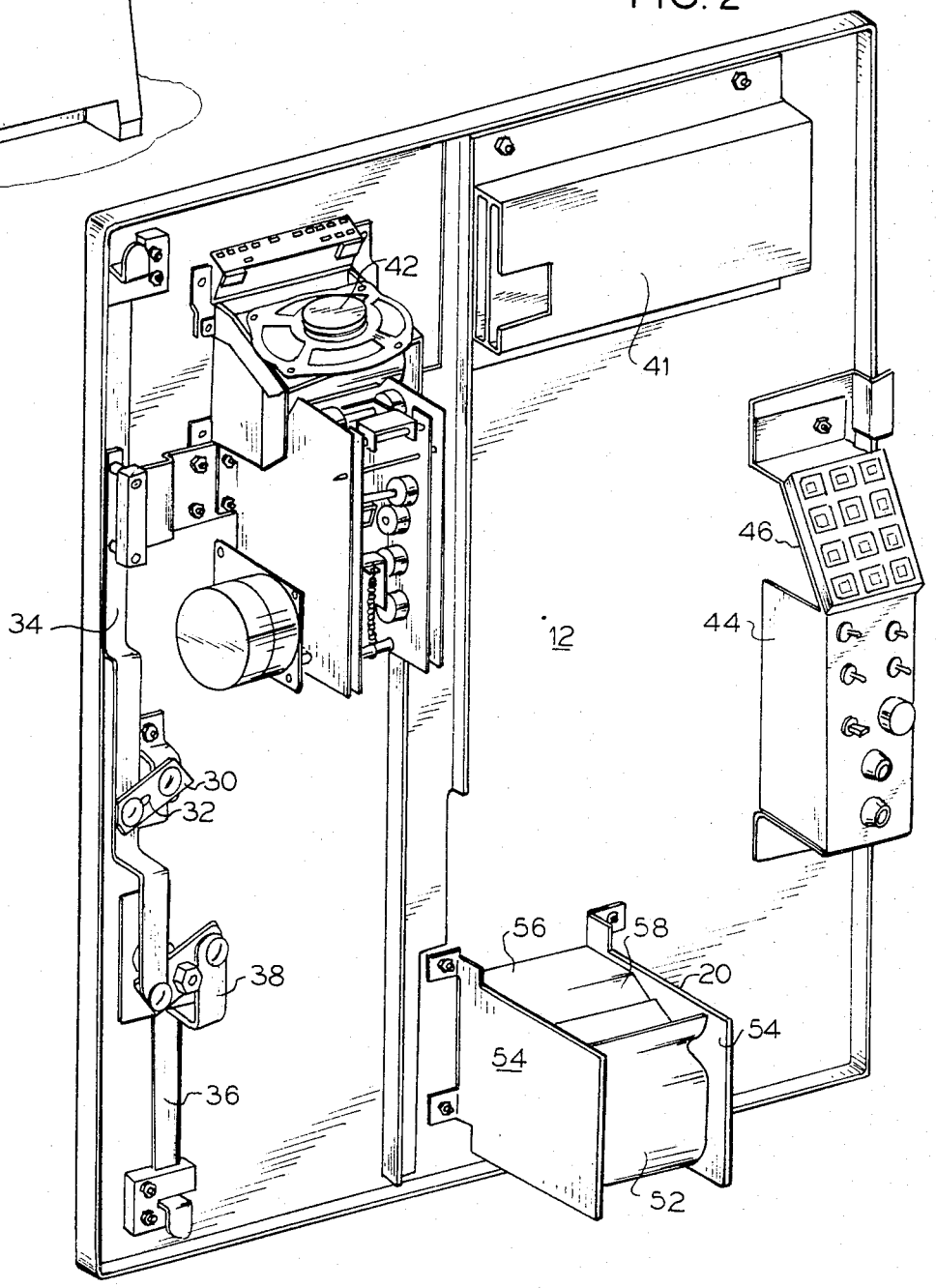

FIG. 9
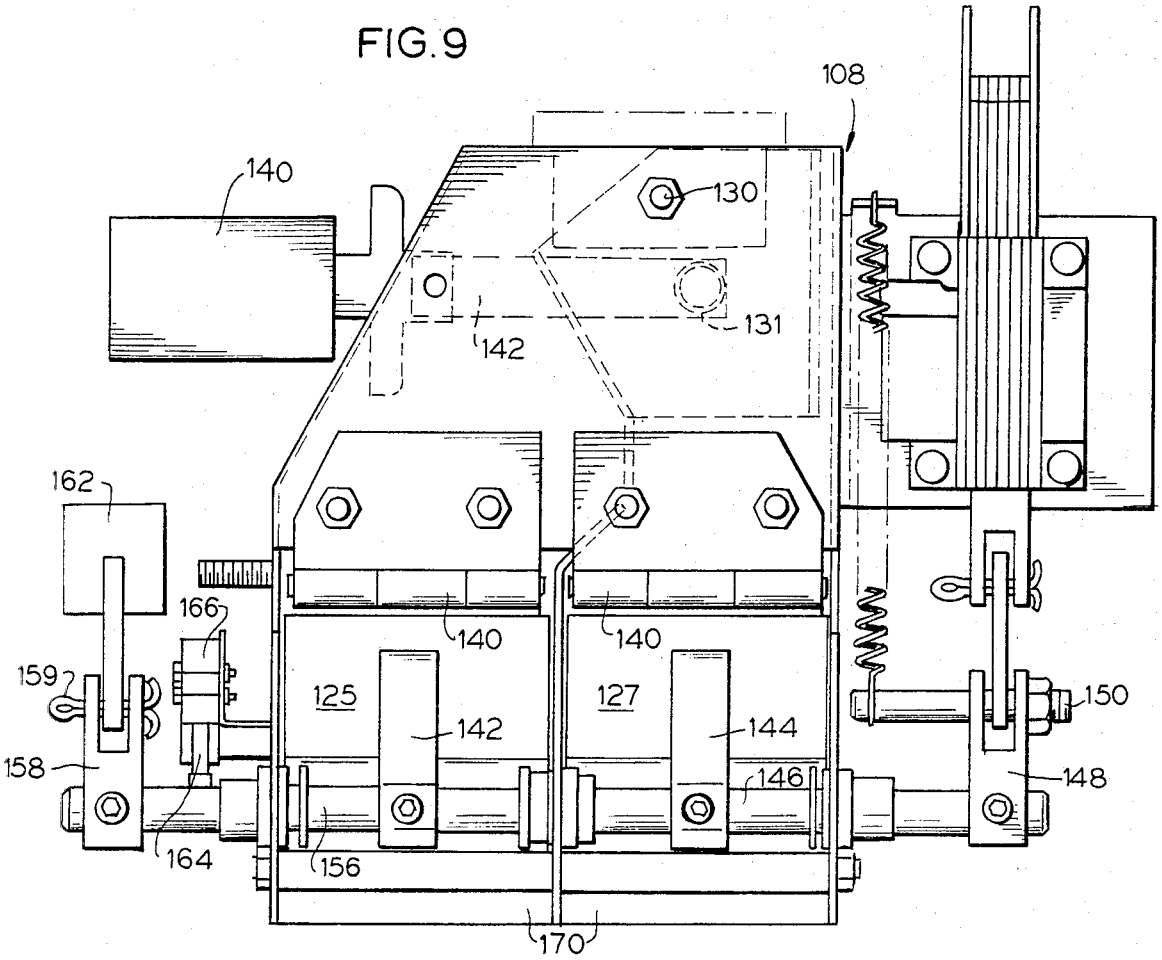
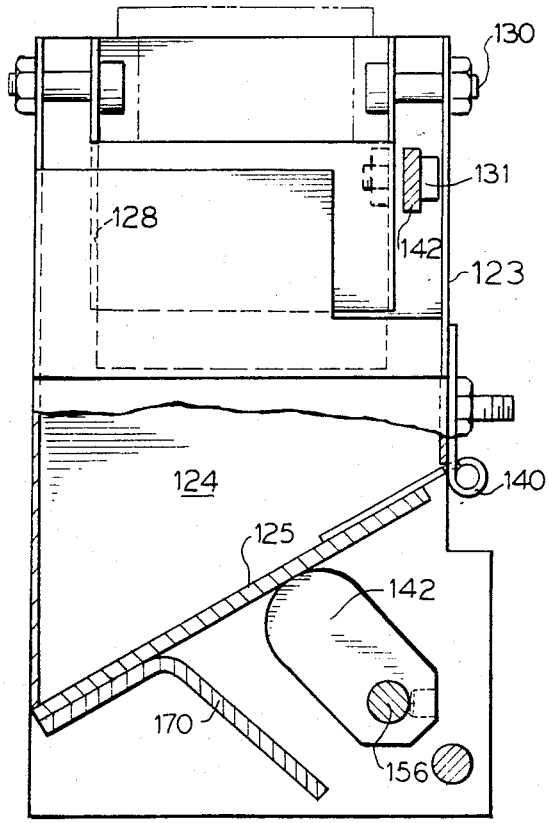
FIG. 10

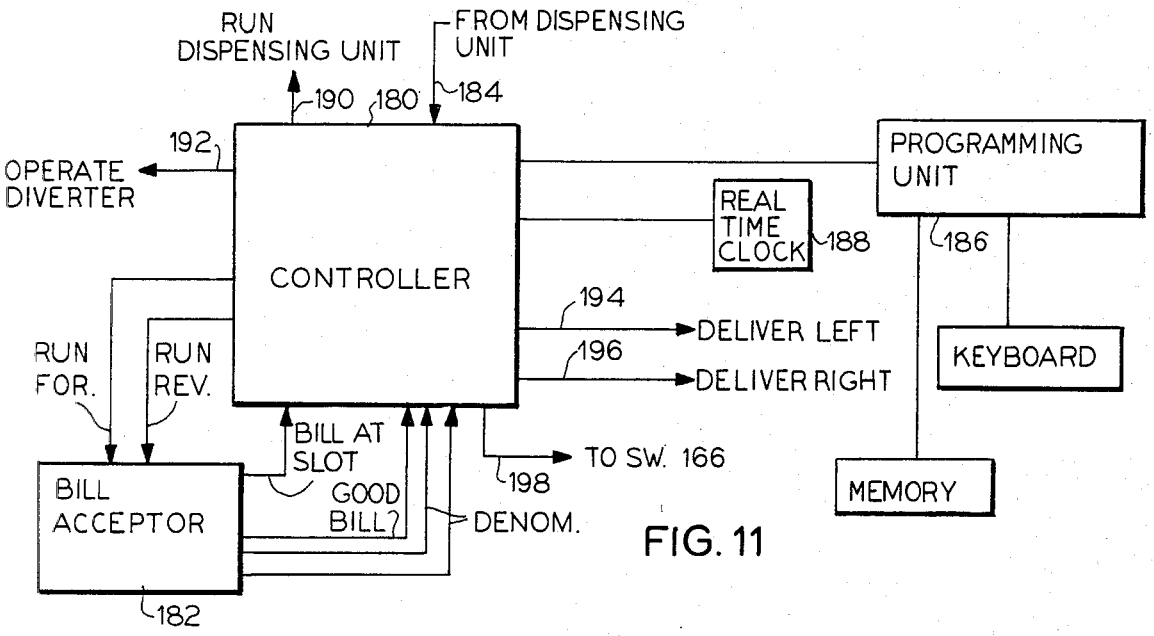
FIG. 11
FIG. 12
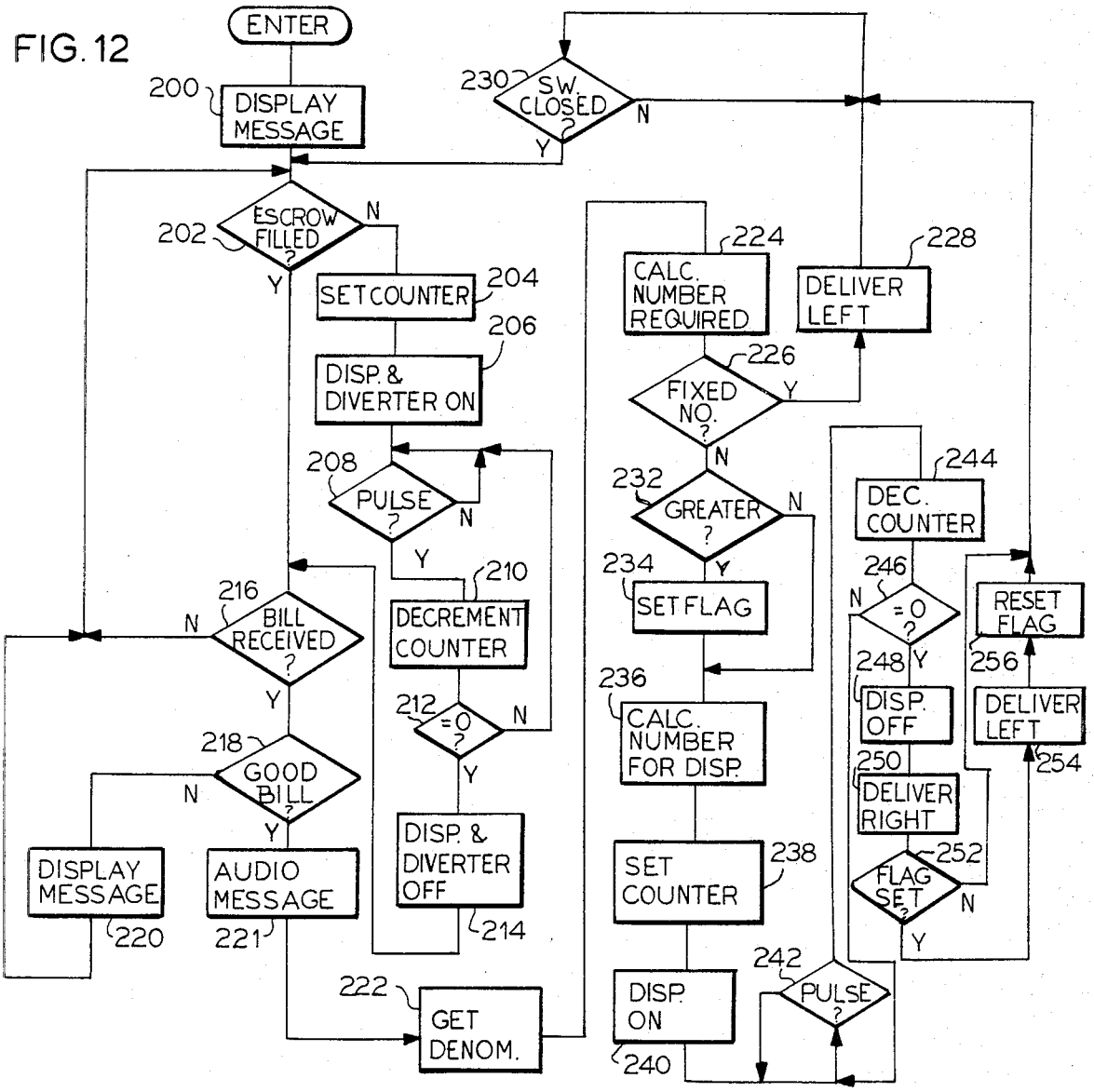

DISPENSING MACHINE WITH REMOVABLE DISPENSING UNIT

BACKGROUND OF THE INVENTION

1. Field of the Invention

The present invention relates to a dispensing machines, and more particularly to such a machine which is adapted to dispense a plurality of coins, tokens, disks or the like, in response to receipt of a given quantity of money in the form of paper currency.

2. The Prior Art

A number of designs of dispensing machines are known, some of which are able to dispense change for a dollar bill in response to receipt of the dollar bill within an input slot. Although such machines are effective for the purpose for which they are intended, they are relatively slow, and when such machines are used as change makers in a location such as a video game arcade, a relatively large number of such machines is required in order to provide normal change-making service. Accordingly, it is desirable to provide a dispensing machine which is adapted to dispense tokens or the like more rapidly. It is also more desirable to provide such a machine with a large storage capacity so that it is necessary to refill the storage hopper only relatively infrequently.

BRIEF DESCRIPTION OF THE INVENTION

A principal object of the present invention is to provide a dispensing machine adapted to rapidly dispense objects such as disks, tokens or the like.

Another object of the present invention is to provide such a machine with a large storage capacity to minimize the frequency at which the storage within the machine must be replenished.

Another object of the present invention is to provide a control system for a dispensing machine which is programmable to dispense a different number of tokens at different hours of the day or days of the week, as desired.

A further object of the invention is to provide a mechanism for a dispensing machine which readily enables disassembly of the apparatus for maintenance and service without requiring the supply magazine to be emptied.

In accordance with one embodiment of the present invention there is provided a dispensing machine having a housing with a front panel hinged thereto, the front panel having a slot for accepting currency of various denominations, and a delivery tray for delivering a plurality of tokens in response to units of paper currency being received, a supply hopper mounted within the interior of the housing, an intermediate hopper slidably mounted below said supply hopper for receiving tokens therefrom, a dispensing unit located beneath said intermediate hopper for receiving tokens therefrom and dispensing the same, one at a time, into one of two delivery chambers located below said dispensing unit, a diverter mounted below said dispensing unit and above said two chambers for diverting tokens dispensed from said dispensing unit into one of said two chambers, and means for releasing tokens from both of said chambers simultaneously into a delivery tray, where they are accessible to an operator of the machine.

The present invention achieves the object of providing an extremely large storage capacity of tokens within the supply hopper, so that the hopper need be attended only relatively infrequently. The interrelationship of the parts, including the intermediate hopper and the dispensing unit allows for easy access to the various parts for service and maintenance, without the necessity for emptying the hopper. The provision of two compartments below the dispensing unit allows for a mode of operation in which one compartment is adapted to receive a fixed quantity of tokens before any currency is deposited in the machine, to make this quantity available immediately, without waiting for operation of the dispensing unit. When a different quantity of tokens is required to be dispensed, the dispensing unit delivers the required quantity not already dispensed into one compartment into the other compartment, and both compartments are released to the delivery tray when the total quantity required has been dispensed. These and other objects and advantages of the present invention will become manifest by an inspection of the following description and the accompanying drawings.

BRIEF DESCRIPTION OF THE DRAWINGS

Reference will now be made to the drawings in which:

FIG. 1 is a perspective view of an illustrative embodiment of the present invention;

FIG. 2 is a perspective view of the inside of the front panel of the apparatus of FIG. 1;

FIG. 9 is a front elevation of the diverter and delivery chamber assembly;

FIG. 10 is a vertical cross-sectional view of a portion of the apparatus of FIG. 9;

FIG. 11 is a functional block diagram of the control system; and

FIG. 12 is a flow chart illustrating operation of the control unit.

DESCRIPTION OF THE PREFERRED EMBODIMENT

Figure 3:
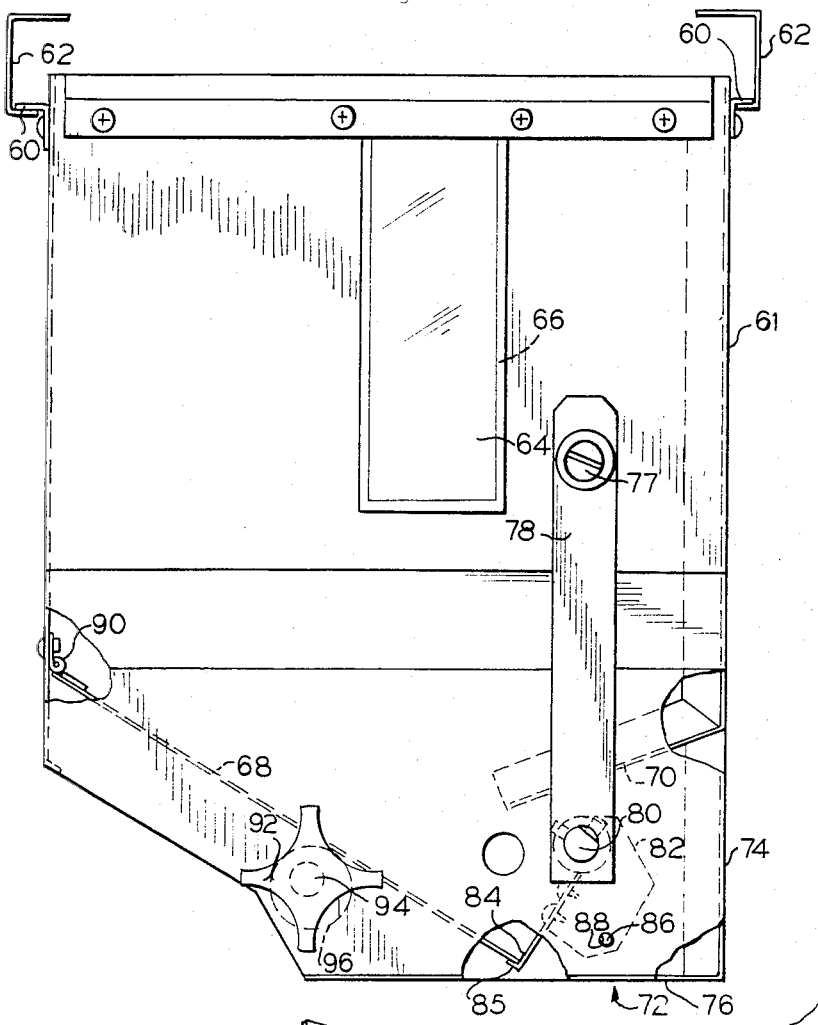
FIG. 3 is a front view of a supply hopper contained within the apparatus of FIG. 1.
Figure 4:
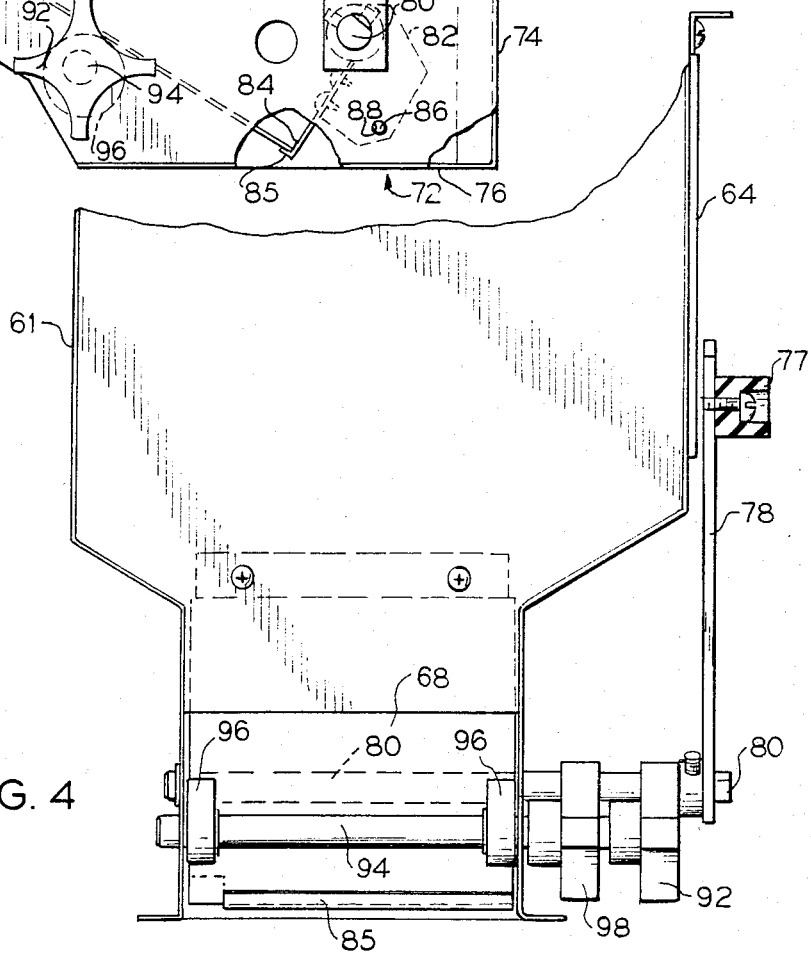
FIG. 4 is a side elevational view of the hopper of FIG. 3.

Referring now to FIG. 1, an illustrative embodiment of the present invention is illustrated. It incorporates a housing 10, having a front panel 12 hinged to the housing 10 by means of a hinge 14. The front panel 12 has a display unit 16 for displaying messages to the operator or serviceman, and a currency receiving slot 18 for receiving currency from an operator. A delivery tray 20 is provided for dispensing tokens in accordance with the denomination of the currency inserted into the slot 18. A lockable handle 22 is provided for operating a latch, which makes it possible to open the front panel 12 by swinging it about the hinge 14, when the latch 22 is first unlocked with a key.

The top panel 24 of the cabinet 10 is formed of sheet metal and has a sliding panel 26 with a key lock 28. When the lock 28 is unlocked the panel 26 may be slid horizontally, to uncover an aperture in the panel 24 above the hopper, making it possible to insert additional tokens into position in the hopper through the aperture.

A perspective view of the reverse side of the front panel 12 is illustrated in FIG. 2. It is seen that the lock 22 is connected to a rotatable shaft 30 which is adapted (when unlocked) to rotate a link 32 which moves a locking bar 34 upwardly, and another locking bar 36 downwardly, the latter being driven by a bell crank 38. The locking bars 34 and 36 are received behind fixed portions of the cabinet 10, to maintain the panel 12 in closed position while the lock 22 is locked.

A bill acceptor unit 40 is mounted on the front cabinet behind the slot 16, and is adapted to receive units of paper currency through the slot 16, and scan them for determining their genuineness and denomination. It incorporates a loudspeaker 42, by which a variety of audible signals may be provided to the operator. Suitable bill acceptors are commercially available and therefore need not be disclosed in detail herein.

The display unit 42 is located on the front panel 12 behind the display screen 16, and is adapted to provide the display which the operator or serviceman sees on the screen 16. Preferably, the display comprises a rectilinear series of alphanumeric readout devices, such as LED's so that instructions can be given to the operator. The operator may also receive audible instructions from the loudspeaker 42. Preferably the information displayed on the display panel 16 instructs an operator that the machine is operational, and also indicates the condition of the machine such as whether a door is open or left unlocked, the amount of money received by the machine within a given period, and/or the number of coins or tokens yet to be dispensed remaining in the machine. Since regular customers or operators do not need this latter information, this information is preferably provided by the display 42 only when a serviceman inserts a key into a key-operated switch (not shown) to activate this mode of the display. By means of these messages, routine service, such as adding more tokens to the supply hopper, does not require opening of the front panel 12.

A control unit 44 is also located on the inside front panel 12 of the machine. It incorporates a microprocessor and a keyboard 46 for the purpose of entering instructions and data into the microprocessor for the purposes of programming and maintenance. A control panel 48 is also provided with a number of switches and controls for facilitating programming and maintenance of the microprocessor and the control system.

The delivery tray 20 is bolted to the inside the front cover 12, and constitutes a horizontal shelf 50 (FIG. 1) for temporarily holding a plurality of dispensed tokens, together with a rear wall 52, and sidewalls 54 for confining the tokens until they are removed manually by an operator. Above the shelf 50 is an upper wall 56 having a sloping rear portion 58 which functions as an inclined plane to guide tokens delivered from above the tray 20 down into the space above the shelf 50. The sloping wall 58 prevents an operator or customer from reaching the delivery chambers with his hand through the delivery tray.

Referring now to FIG. 3, a front elevational view of the supply hopper 61 within the cabinet 10 is illustrated. The upper portion of the hopper is rectangular in horizontal cross section; with a pair of support brackets 60 secured to the upper end of the sides. The support brackets 60 are received in slidable engagement with rack members 62 which are secured to the upper panel 24 of the case 10, so that the hopper can be removed, if desired, by sliding it directly out of the cabinet 10 when the front panel 12 is in open position. A transparent plate 64 formed on plexiglass or the like, is received in a slot 66 on the front sidewall of the hopper, so that when the level of tokens to be dispatched is above the bottom of the plate 64, the level can be inspected visually when the front panel is swung open.

The bottom of the hopper 61 has a sloping bottom wall 68 on its left side, as illustrated in FIG. 3, which extends over about $\frac{3}{4}$ of the horizontal area of the hopper. A sloping wall 70 is secured to the opposite wall of the hopper (the right wall as illustrated in FIG. 3), and extends over the remainder of the horizontal area of the hopper, overlying an opening 72 at the bottom of the hopper defined between the bottom end of the sloping wall 68 and the bottom end of the rear wall 74 which forms a horizontal lip 76 at the right side of the bottom, as illustrated in FIG. 3.

The short wall 70 which overlies the opening 72, relieves tokens within the vicinity of the opening 72 from the weight of the tokens above it. This tends to minimize jams which might otherwise occur in the vicinity of the opening 72, which could prevent tokens from proceeding below that point.

A crank 78, with a handle 77, is pivoted to a shaft 80 which extends through the hopper 61 above the opening 72 and below the sloping wall 70. A pair of brackets 82 are fixed to the shaft 80, on each side of the shaft within the interior of the hopper, and a bottom plate 84, with an end lip 85, is fixed to the brackets 82. When the handle is in the positon shown in FIG. 3, the bottom plate 84 engages the bottom end of the sloping panel 68, with the lip 85 hooked on the bottom end of the panel 68, preventing any tokens from leaving the supply hopper 61. Even though the area above the shaft 80 below the sloping wall 70 is open, and still in communication with the opening 72, no tokens leave the hopper by that means, because the sloping wall 70 effectively shields that space from the weight of the tokens at the upper part of the hopper.

The bracket 82 located at the front end of the shaft 80 has a detent pin 86 which cooperates with a hole 88 in the front panel wall of the hopper. This detent prevents accidental movement of the bottom plate 84 during a period in which the hopper is to remain closed. To open the hopper, the detent pin 86 is pushed manually beyond the interior of the wall of the hopper, after which the crank 78 may be moved, with its handle 77, in a counterclockwise direction as seen in FIG. 3, swinging the bottom wall 84 into the position shown in phantom lines, and making it possible for tokens to leave the hopper through the opening 72.

The bottom wall 68 is hinged to the lefthand wall of the hopper 61 by means of a hinge 90, and it is adapted to be rotated about the axis of the hinge 90 as a pivot point, by means of a handle 92. The handle 92 is secured to a shaft 94, and a pair of cams 96 are secured to the shaft 94. When the handle 92 is turned, the cams 96 pivot the sloping wall about the hinge 90, and by means of moving the wall 68 up and down about this pivot point, any tendency for tokens to jam at the opening 72 may be minimized. A second handle 98 is threaded on the shaft 94 and may be used to lock the shaft 94 in a desired position by simply turning the handle 98 until it is tight against the side wall of the hopper. In this way, the precise angular position of the sloping wall may be controlled, so as to operate most effectively with any size tokens which may be used. In addition, if a jam should occur, it can be broken up by manual movement of the wall 68, with the handle 92.

Figure 5:
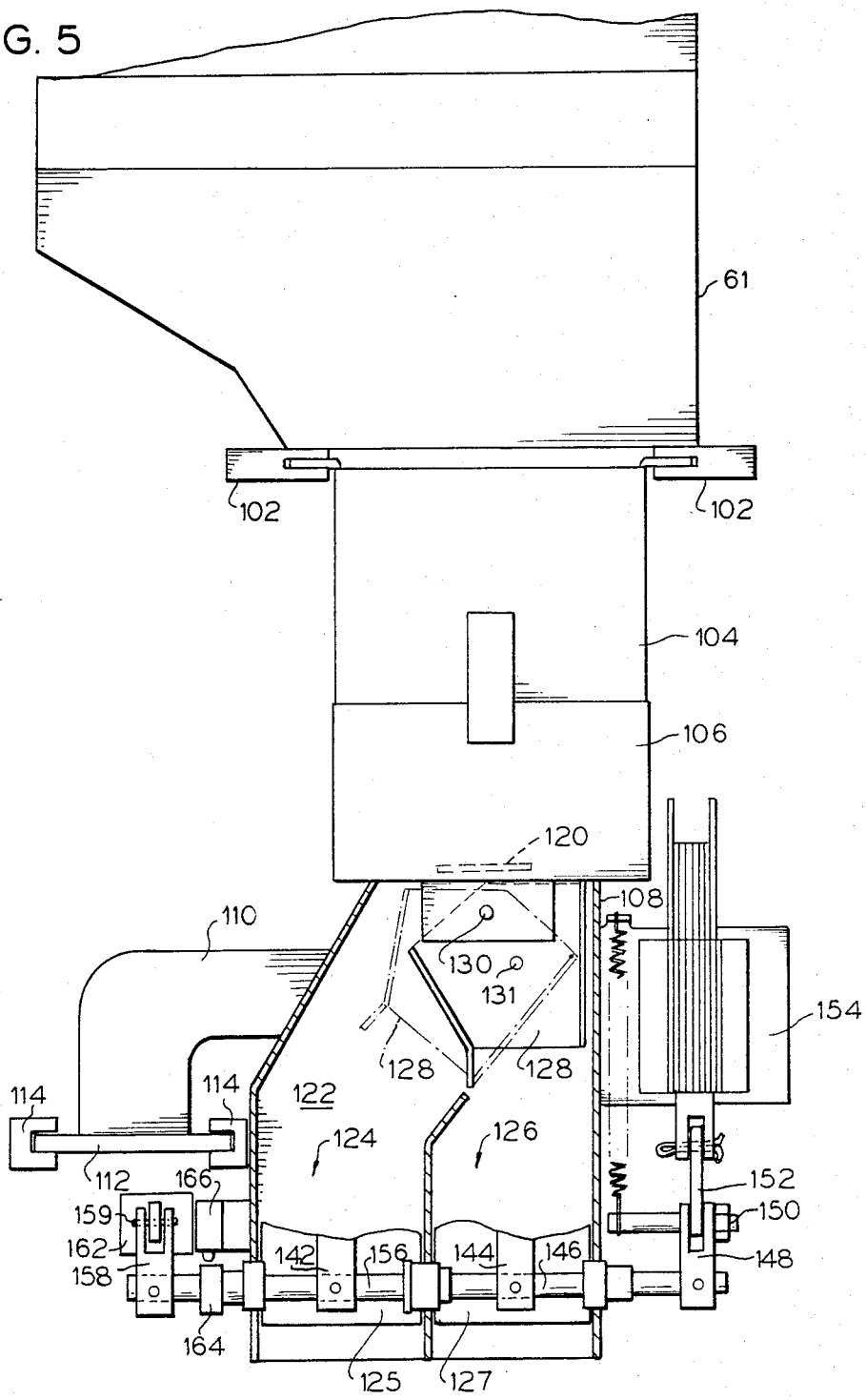
FIG. 5 is a front elevational view of apparatus located below the hopper of FIGS. 3 and 4.

Referring now to FIG. 5, it is seen that a pair of guides 102 are mounted at the bottom of the hopper 61, and an intermediate hopper assembly 104 is mounted directly below the hopper 61, and is slidable relative to the hopper 61 of slide 122 received in the guides 102. A dispensing unit 106 is secured to the bottom of the intermediate hopper 104, and a diverter and delivery chamber assembly 108 is secured to the bottom of the dispensing unit 106. The units 104, 106 and 108 are all connected to a support bar 110 which in turn is connected to a slide 112 which is received in guides 114 secured to the rear panel of the casing. By means of the slides 122, and 112, the entire mechanism can be withdrawn from the housing, with the hopper 61 remaining in position, and the rest of the apparatus within the casing 10, if that should be required.

The function of the intermediate hopper 104 is to guide tokens from the bottom opening 72 of the hopper 61 to the input of the dispensing unit 106.

Figure 6:
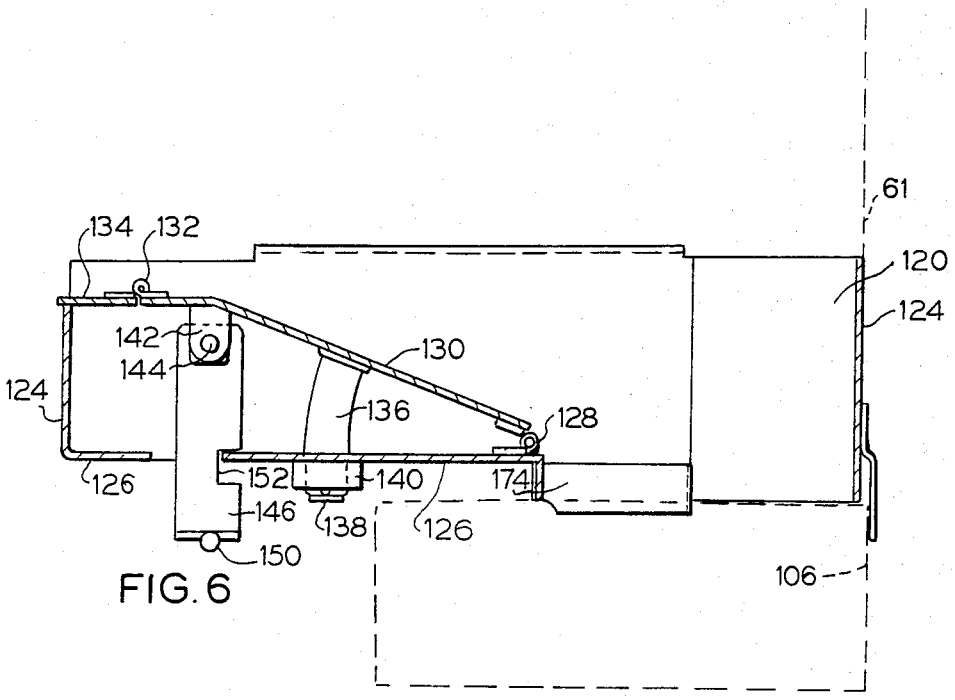
FIG. 6 is a vertical cross-section through the intermediate hopper.

FIG. 6 shows a vertical cross-section of the intermediate hopper. It is formed with a pair of sidewalls 120, each of which has a slide 122 which is adapted to be received in one of the guides 102. The front part of the intermediate hopper is formed in the shap of a circular cylinder, with a vertical axis coaxial with the circular cylindrical dispensing unit 106. The front wall 124 has the shape of half of the cylinder, and is joined to planar sidewalls 120. A rear wall 124 extends upwardly from the bottom wall 126 which interconnects the sidewalls 120. The bottom wall 126 has apertures for a purpose which is described in more detail hereinafter.

Figure 7:
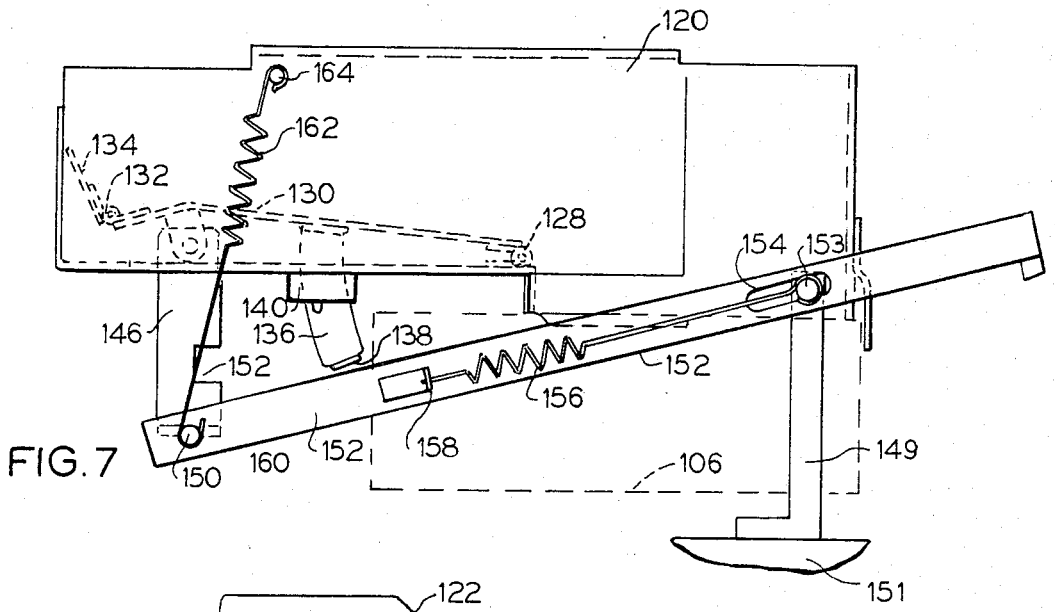
FIG. 7 is a side elevation of the intermediate hopper.

Hinged to the bottom wall 126 by means of a hinge 128 is sloping ramp 130, which assumes the position illustrated in FIG. 7 when no tokens are bearing on the ramp 130. The rear end of the ramp 120 is hinged by means of a hinge 132 to a flap 134 which extends rearwardly over the rear end wll 124. The sides of the sloping ramp 130 and the flap 134 fit closely within the side walls 120, so there is no space for tokens to fall below the ramp 130, but must emerge from the intermediate hopper into a dispensing unit 106.

A bracket 136 is welded to the bottom of the sloping ramp 130, and proceeds downwardly through an aperture in the bottom wall 126 and terminates in a horizontal leg 138. The leg 138 engages the actuator of a miniature switch 140, such that when the ramp 130 is in the position illustrated in FIG. 7, the switch 140 is closed. During operation, the space within the intermediate hopper is filled with tokens to be dispensed, and when there are at least 130 tokens remaining to be dispensed, the sloping ramp 130 is pivoted slightly downwardly, against the force of the spring 128, to open the switch 140. In normal dispensing operation, therefore, the switch 140 is open, and when the switch 140 becomes closed, this signals a condition which less than 130 tokens remain within the intermediate ramp.

Another bracket 142 is welded to the bottom of the sloping ramp 130, and supports a pivot pin 144 to which a link 146 is pivoted. The link 146 extends through an opening 148 in the bottom wall 126, and terminates in a horizontally extending leg 150.

The link 146 has a notch 152 which engages the forward edge of the aperture 148 in the bottom wall 126. The notch 152 prevents the link 146 from moving downwardly more than a slight distance, but this distance is sufficient to permit the arm 138 to move downwardly sufficiently to de-energize the switch 140.

The hinged connection of the sloping ramp 130 facilitates the removal of the intermediate hopper from the supply hopper 61. More particularly, when the sloping ramp 130 is lowered by being rotated in a counterclockwise direction about the hinge 128, an additional space or volume is provided above the intermediate hopper, and below the supply hopper, which receives the tokens supplied by the supply hopper, so that there are no tokens in the space between the supply and intermediate hoppers to block removal of the intermediate hopper. Of course, the main hopper is first closed by means of the crank 78, as already described above.

FIG. 7 shows a side elevational view of the intermediate hopper assembly and illustrates the actuating link by which the sloping ramp 130 may be lowered.

A bracket 149 is provided which is secured to a shelf 151 which is partially shown in FIG. 7. A pivot shaft 153 is mounted at the top end of the bracket 149, and is also secured to the wall of the intermediate hopper near its forward end. A link 152 has an elongate aperture 154 which receives the pivot shaft 153, such that the link 152 may be moved longitudinally relative to the pivot shaft 153, and also rotated about it. A spring 156, connected between the pivot shaft 153 and a lug 158 on the arm 152, keeps the link normally in its forward position, with the notch 152 engaged in the bottom wall 126 of the intermediate hopper. The arm 150 which forms the bottom of the link 156 is received in an aperture 160 in the arm 152. Another spring 162 is connected from the arm 150 to a fixed point 164 on the intermediate sidewall 120, to urge the arm 152 and the remaining assembly upwardly.

In operation, when the arm 152 is pushed rearwardly, against the force of the spring 156, the notch 152 is removed from engagement with the rear wall, so that the sloping ramp 130 can be lowered by rotating the arm 152. It remains in lowered condition, against the force of the spring 162, because of the weight of the tokens on the ramp 130. With the sloping ramp 130 in lowered condition, enough relief is provided for the tokens within the intermediate hopper to prevent any binding which might otherwise occur as the intermediate hopper is being withdrawn from its normal position in relation to the main hoopper 61.

Figure 8:
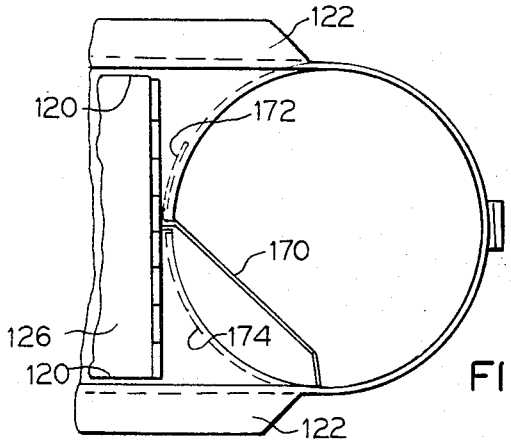
FIG. 8 is a plan view of a portion of the intermediate hopper.

Referring now to FIG. 8, a plan view of the forward portion of the intermediate hopper is illustrated. The circular opening at the bottom of the forward end of the intermediate hopper is illustrated, with the forward circular cylindrical wall 124 at the forward side. The rear side of the space is defined by the circular cylindrical wall 174 which has a separate end attached to the bottom wall 126, and joins with the wall 124 to define a circular cylindrical projection or flange at the bottom of the forward portion of the intermediate hopper. The upper end of the spring 170 is even with the bottom wall 126, and its lower edge extends sidely below the lower edge of this circular cylindrical flange. The end 172 is welded to the wall 174, and the spring 170 extends obliquely into the space defined by the circular cylindrical boss and has a slight bend near its end 178. The end 178 is free, and slightly touches the inside of the wall 124.

It has been found that the spring 170, greatly facilitates the entry of circular disk-like tokens into the dispensing unit 106, and substantially prevents jams of tokens which might otherwise occur. The precise physical mechanism by which the spring 170 avoids the tendency of the tokens to jam is not well understood, but the effectiveness of the spring 170 for this purpose has been noted.

The dispensing unit 106 is a conventional dispensing unit for the dispensing of disks, tokens or the like, and need not be described in detail. It is commercially available. In general, the dispensing unit 106 has a form of a right circular cylinder, with a vertical axis. Most of the interior of the cylinder is open, to receive tokens from the intermediate hopper 104, and at the bottom a plate is mounted, rotatable about a vertical axis. The plate has a number of apertures which are sized to receive individual tokens or disks, and as the plate spins, the disks or tokens within the interior of the dispensing unit 106 find their way into one of the apertures on the rotating plate. As the plate rotates, the disks are brought to a position near the front of the dispensing unit 106 where they are dispensed downwardly through an aperture in the bottom wall adjacent the bottom of the plate. In this manner, the disks or tokens are dispensed individually, one for each aperture of the rotating plate which passes the aperture in the bottom wall. When the disk has six apertures, one token is dispensed for each 60° of rotation of the rotating dispensing plate. The number of tokens dispensed by the dispensing unit can be determined by observing the number of revolutions of the rotating plate. For example, 36 tokens are dispensed during six complete revolutions of the plate mentioned above which has six apertures.

As illustrated in FIG. 5, a diverter assembly 108 is located directly below the dispensing unit 106. The place of dispensing of individual coins or tokens is indicated in FIG. 5 by the dashed rectangle 120. The diverting and delivery assembly 108 is shown in FIG. 5 partly in cross-section. As illustrated in FIG. 5 it has a rear wall 122, and a pair of compartments 124 and 126. A diverter unit 128 is mounted for pivotal movement about a shaft 130 which is supported by the rear wall 122 and the front wall which is not shown in FIG. 5. A pin 132 is connected to an actuating arm controlled by a solenoid for moving the diverting unit 128 to either of two stable positions. In the position illustrated in FIG. 5, the diverter unit 128 is in position to channel the tokens 120 into the compartment 126. To this end, the delivery unit 128 has a sloping left hand wall 132 and a right hand wall 134 which, in the position illustrated in FIG. 5, is generally vertical. A rear wall 136 interconnects the walls 132 and 134, and another forward wall (not shown) joins the walls 132 and 134 at their forward edges. The width of the walls 132 and 134 are sufficient to fill the space between the rear wall 122 of the assembly and its forward wall, so that all of the tokens dispensed by the dispensing unit 120 are directed through the diverter unit 128.

FIG. 9 illustrates a solenoid 140 which is connected to a link 142 pivoted to the pin 131. When the solenoid is energized, the diverter unit 128 is rotated in a clockwise direction about the shaft 130, so that tokens are diverted into the delivery chamber 124.

Each of the delivery chambers is closed at its bottom by a sloping closure wall 125 and 127, respectively. The two walls 125 and 127 are each hinged to the front panel 123 of the assembly by means of a hinge 140. The closure walls 125 and 127 are maintained in closed position by a pair of cams 142 and 144 respectively, each of which is mounted on a shaft adapted for rotation by a solenoid. The right handed cam 144 is connected to a shaft 146 which extends through the side wall of the assembly 108 and is connected with a yoke 148. The yoke has a pin 150 pivoted to an actuator 152 of a solenoid 154, so that energization of the solenoid 154 rotates the shaft 146, thereby rotating the cam 144 away from the bottom wall 127, permitting it to fall into open position by gravity, and by the weight of the coins above it. The bottom edge of the wall 147, in closed position, is held tightly in engagement with the rear wall 122, so that there is no tendency for the tokens to escape from the delivery chamber 126 until the bottom wall 127 is open.

The cam 142 for the left hand chamber 124 is mounted on a shaft 156 which extends out the opposite side of the assembly 108 and supports a yoke 158. The yoke 158 has a pin 159 which is pivoted to an actuator 160 of the solenoid 162, so that energization of the solenoid 162 is adapted to rotate the shaft 156, and rotate the cam 142 away from the wall 125. This permits the wall 125 to open a space at the bottom of the chamber 124 to permit the tokens in this chamber to be delivered to the delivery tray. The shaft 156 also has a cam 164 which is associated with a miniature switch 166, which senses the rotation of the shaft 156. In this manner, the signal from the switch 166 indicates an opening of the delivery chamber 124. A similar switch (not shown) may be provided for the delivery chamber 126 as well.

As shown in FIG. 10, the cam 142, when the door 125 is in closed position, has an overcenter relationship relative to the axis of the hinge 140, so that it is not possible to open the door 125 by pulling downwardly thereon. A baffle 170 is welded to the bottom surface of the door 125 and extends downwardly at an angle, which effectively prevents an operator from reaching the cam 142 or the shaft 156 by extending his hand up from the area of the delivery tray. Although FIG. 10 illustrates the cross-section only of the delivery chamber 124, it will be appreciated that the other delivery chamber 126 is arranged in a similar manner.

In operation, the delivery chamber 124, sometimes referred to as the escrow chamber, is filled with a fixed number of tokens prior to any currency unit being received in the machine. This fixed number, such as 40 tokens, may be the number of tokens dispensed in response to receip t of a $10.00 bill. Thus the machine is always ready to deliver to the delivery tray 40 tokens, and when a $10.00 bill is inserted into the receiving slot, these tokens may be dispensed immediately, without waiting for operation of the dispensing unit.

When a lesser number of tokens is desired, as when a $1.00 or $2.00 or $5.00 bill is inserted into the chambeer, the fixed number of tokens in the escrow compartment 124 is held in position, and the desired number of tokens are counted into the other delivery chamber 126. When the required number have been dispensed into this chamber, the solenoid 154 is energized, and these tokens are delivered to the delivery tray.

When a greater numbrer of tokens than 40 is desired, as when a $20.00 bill is received by the bill acceptor, the difference between the desired number of tokens and the fixed number already stored in the escrow compartment 124 is calculated, and this difference is dispensed into the compartment 126. When the correct number of tokens have been dispensed into the compartment 126, both compartments are open by simultaneously energizing the solenoids 162 and 154, to deliver all of the tokens to the delivery tray. Thereafter, when the door 125 is returned to its closed position, (as indicated by operation of the switch 166), the dispensing unit dispenses the fixed number of tokens into the escrow compartment 124 to make ready for the next operation.

Referring to FIG. 11, a functional block diagram of the control system is illustrated. The controller unit 180 has a number of inputs and a number of outputs. Inputs are received from the bill acceptor 182, which inform the controller 180 that a bill has been accepted and the denomination of the bill. An input is also accepted over a line 184 from the dispensing unit indicating, by a series of pulses, the number of tokens dispensed by the dispensing unit into one of the delivery compartments. Preferably the signals on line 184 comprise one pulse for each token dispense, and these pulses may be produced by a camoperated switch, for example, which closes once for each partial revolution of the rotating plate within the dispensing unit, such that one pulse is produced for each token dispensed.

A programming unit 186 is provided, having a storage device for storing information concerning the number of tokens to be dispensed at given times during the day, and for different days of the week. A real time clock 188 is also provided for furnishing signals to the controller in response to the current day of the week and the current time of day, so that the correct number of tokens to be dispensed for any unit of currency can be calculated. The bill acceptor 182 is also connected to the controller, to supply signals indicating insertion of a bill into the throat, and receipt of a genuine bill of given denomination. Outputs from the controller cause the motor of the bill acceptor to be energized in forward or reverse direction, the latter to reject a non-acceptable bill. Other outputs from the controller comprise a line 190 which is adapted to cause the dispensing unit to operate until the required number of tokens has been dispensed, a line 192 which operates the diverter mechanism 128, to select one of the two delivery compartments 124 and 126, and lines 194 and 196 which are connected respectively to the solenoids 162 and 154, causing them to be energized so as to dispense the contents of the delivery chambers 124 and 126 when appropriate. In addition, a line 198 is connected with the switch 166, to indicate that the door 125 has been closed, following operation of the solenoid 162, so that the fixed number of tokens can be dispensed into the escrow compartment 124.

FIG. 12 illustrates a flow chart which comprises one arrangement in which the operation of the controller may be carried out. The flow chart of FIG. 11 contains a series of boxes, which may correspond to be steps in the program performed by microprocessor unit. Alternatively, the individual boxes of FIG. 12 may be constructed as individual units of apparatus, in which case FIG. 12 describes the structural rather than functional inter-relationships. In reference to FIG. 11, the boxes will be referred to as units, to indicate that they may be embodied in either program steps or individual circuits.

When the system of FIG. 12 is initiated a unit 200 receives control, which functions to display a message to the operator or customer by means of the display panel on the front panel of the machine. The message may indicate the day, date and time of day, and indicate to the customer how many tokens he can receive for $1.00, $2.00, etc. It gives instructions to the customer to insert bills of given denominations into the bill receiving slot. Preferably these messages are given sequentially, so that only a relatively few characters are required to display the message at any one time.

Concurrently with the message being displayed, unit 202 receives control which determines whether the left or escrow delivery compartment has been filled. If not, unit 204 receives control which sets a counter after which unit 206 turns the dispenser on. Unit 208 then examines pulses received from the dispenser and decrements the counter by means of unit 210 each time a pulse has been received. Then unit 212 determines whether the counter has been reduced to zero, and if not control is returned to unit 208. In this way, the fixed number of tokens corresponding to the setting of the counter by the unit 204 are dispensed into the left hand compartment. When this has been accomplished, unit 14 receives control which turns off the dispenser and passes control to unit 216. If the unit 202 had found the compartment already filled, control would pass directly to unit 216.

The unit 216 determines whether a bill has been inserted into the bill acceptor, and if not, control returns to the unit 200 and 202 to repeat the sequences described above. When a bill is inserted, unit 218 activates the bill acceptor to determine whether the bill is genuine, in accordance with signals generated by the bill acceptor. If not, unit 220 receives control which displays an appropriate message in response to non-genuine or unreadable bill, and rejects the bill. If the bill is found to be genuine and accepted, unit 220 receives control and causes the loudspeaker 42 to issue an audible message such as "Thank you". Unit 222 then receives control and determines the denomination based on signals from the bill acceptor, and then unit 224 calculates the number of tokens to be delivered to the delivery tray. This is based on the day of the week, and time of day, in accordance with the program unit 186 (FIG. 10). After the appropriate number has been calculted, unit 226 receives control and determines whether the number of tokens to be delivered is equal to the fixed numnber. If so, unit 228 receives control which trips the solenoid for delivery of the tokens from the left compartment, and passes control to the unit 230 which examines the state of the switch indicating that the door to the left hand compartment has been closed. The unit 230 causes the control to wait in this position until the switch is closed indicating closure of the door, after which control is returned to units 200 and 202, so that the left hand compartment can be loaded again.

When the number to be delivered is not equal to the fixed number, unit 232 receives control and determines whether the number to be dispensed is greater than the fixed number. If so, a flag is set by unit 234 and unit 236 receives control. If not, the unit 236 receives control directly. Then the unit 238 receives control which sets a counter and unit 240 turns the dispenser on. Unit 242 then inspects for pulses from the dispenser, and decrements the counter accordingly, by means of unit 244. When the counter has been reduced to zero, the unit 246 passes control to the unit 248, and otherwise returns control to the unit 242 until the correct number has been dispensed into the righthand compartment. Then unit 250 receives control which trips the solenoid for the right delivery compartment, which delivers the tokens from the right compartment. Unit 252 then inspects the flag which may have been set by the unit 234, and if it is found to be set, the unit 254 trips the solenoid for the left compartment, after which unit 256 resets the flag. Then control is passed to unit 230 which has been described aboce.

It is apparent that various modifications and additions may be made in the apparatus of the present invention without departing from the essential features of novelty thereof, which are intended to be defined and secured by the appended claims.

What is claimed is:

1. A dispensing machine having a bill acceptor for accepting units of currency presented to a currency receiving slot, comprising in combination; a supply hopper for storing a quantity of circular items to be delivered to a delivery tray in response to currency being presented to said slot, housing means for surrounding said bill acceptor and said hopper, said hopper being mounted in fixed position relative to said housing means, a dispensing unit located below said hopper in adjustable position relative to said hopper, said dispensing unit being adapted to dispense tokens into said delivery tray from said hopper in response to a unit of currency being presented to said slot, means for selectively closing the path for tokens between said hopper and said dispensing unit, whereby said dispensing unit may be removed from said housing means without removing tokens from said hopper, and an intermediate hopper disposed between said supply hopper and said dispensing unit, said intermediate hopper having surfaces for supporting a quantity of tokens between said supply hopper and said dispensing unit, and means for selectively lowering one of said supporting surfaces, whereby at least one of said supported tokens in lowered, clearing a space above said supported tokens and below said supply hopper.

2. Apparatus according to claim 1, wherein said intermediate hopper incorporates a sloping supporting wall adapted to pivot about its lower edge, means for manually maintaining said supporting wall in a first position, and manually operable means for selectively pivoting said supporting wall to a position of lower slope, thereby clearing a space above the tokens supported by said supporting wall.

3. Apparatus according to claim 2, including latch means for manually holding said supporting wall in a position of relatively higher slope.

4. Apparatus according to claim 1, including switch means disposed below said supporting wall, and means for changing the operating condition of said switch in response to more or less than a predetermined number of tokens being supported by said support wall.

5. A dispensing machine having a bill acceptor for accepting units of currency presented to a currency receiving slot, comprising in combination; a supply hopper for storing a quantity of circular items to be delivered to a delivery tray in response to currency being presented to said slot, housing means for surrounding said bill acceptor and said hopper, said hopper being mounted in fixed position relative to said housing means, a dispensing unit located below said hopper in adjustable position relative to said hopper, said dispensing unit being adaped to dispense tokens into said delivery tray from said hopper in response to a unit of currency being presented to said slot, means for selectively closing the path for tokens between said hopper and said dispensing unit, whereby said dispensing unit may be removed from said housing means without removing tokens from said hopper, a plurality of delivery chambers located below said dispensing unit, said delivery chambers being connected to said dispensing unit and moveable therewith, and a diverter unit disposed between said dispensing unit and said delivery chambers for selectively diverting tokens into a selected one of said chambers.

6. Apparatus according to claim 5, wherein said diverter unit is funnel shaped, and means pivoting said diverter unit below said dispensing unit into one of two fixed positions, whereby tokens are diverted into one of two delivery chambers.

7. Apparatus according to claim 5, including a plurality of closures each adapted to close the bottom of one of said chambers, and means for selectively opening and closing each of said closures.

8. Apparatus according to claim 7, wherein each of said closures comprise a wall pivoted at one end, with the other end free to pivot about said one end, and cam means engaging one of said walls for manually holding said closure in closed position, whereby said closure is locked into closed position when said cam means is in chamber closing position.

9. Apparatus according to claim 8, including flange means projecting from one of said closure walls for preventing manual access to said cam means.

* * * * *